US008936700B2

(12) United States Patent
Newman et al.

(10) Patent No.: US 8,936,700 B2
(45) Date of Patent: Jan. 20, 2015

(54) METHOD FOR HYDROCARBON REMOVAL AND RECOVERY FROM DRILL CUTTINGS

(75) Inventors: Paul Newman, Bedford (CA); Mukesh Kapila, The Woodlands, TX (US); Zoran Markanovic, Dartmouth (CA)

(73) Assignee: M-I L.L.C., Houston, TX (US)

( * ) Notice: Subject to any disclaimer, the term of this patent is extended or adjusted under 35 U.S.C. 154(b) by 120 days.

(21) Appl. No.: 13/500,570

(22) PCT Filed: Oct. 6, 2010

(86) PCT No.: PCT/US2010/051665

§ 371 (c)(1), (2), (4) Date: Aug. 7, 2012

(87) PCT Pub. No.: WO2011/044260

PCT Pub. Date: Apr. 14, 2011

(65) Prior Publication Data

US 2012/0298559 A1 Nov. 29, 2012

Related U.S. Application Data

(60) Provisional application No. 61/249,134, filed on Oct. 6, 2009.

(51) Int. Cl.
*B01D 11/00* (2006.01)
*C10G 21/00* (2006.01)
(Continued)

(52) U.S. Cl.
CPC ... *C10L 3/00* (2013.01); *C10G 1/04* (2013.01); *C10G 2300/4081* (2013.01); *C10G 2300/80* (2013.01)
USPC ..... 196/14.52; 196/98; 196/138; 196/155

(58) Field of Classification Search
USPC ..... 196/14.52, 98, 138, 155; 175/166; 134/40, 104.4, 109
See application file for complete search history.

(56) References Cited

U.S. PATENT DOCUMENTS 2,396,373 A 3/1946 Henrichsen
4,434,028 A * 2/1984 Eppig et al. ..... 196/14.52
(Continued)

FOREIGN PATENT DOCUMENTS

CN 101036020 A 9/2007
CN 101255789 A 9/2008
(Continued)

OTHER PUBLICATIONS

PCT Preliminary Report on Patentability of PCT Application Serial No. PCT/US2010/051665 dated Apr. 11, 2012.
(Continued)

*Primary Examiner* — Nina Bhat

(57) ABSTRACT

The present invention relates to a system and a method for the extraction of hydrocarbons from drill cuttings in drilling mud. The system for extracting hydrocarbons from drill cuttings includes at least one extraction tank, a carbon dioxide tank fluidly connected to the at least one extraction tank, and at least one separation tank in fluid communication with the at least one extraction tank. The method for extracting hydrocarbons from drill cuttings consists of exposing the drill cuttings to liquid carbon dioxide, solubilizing hydrocarbons from the drill cuttings with the liquid carbon dioxide, heating the liquid carbon dioxide and the soluble hydrocarbons to convert liquid carbon dioxide to carbon dioxide vapor, separating the hydrocarbons from the carbon dioxide vapor, and collecting the separated hydrocarbons.

20 Claims, 9 Drawing Sheets

(51) Int. Cl.

| | |
|---|---|
| ***C10C 1/18*** | (2006.01) |
| ***C10L 3/00*** | (2006.01) |
| ***C10G 1/04*** | (2006.01) |

(56) References Cited

U.S. PATENT DOCUMENTS

| | | | | |
|---|---|---|---|---|
| 4,602,477 | A | 7/1986 | Lucadamo | |
| 4,639,257 | A | 1/1987 | Duckett et al. | |
| 4,762,543 | A | 8/1988 | Pantermuehl et al. | |
| 4,936,887 | A | 6/1990 | Waldo et al. | |
| 6,070,431 | A | 6/2000 | Howard | |
| 6,509,300 | B1 | 1/2003 | Gupta | |
| 6,550,552 | B1 * | 4/2003 | Pappa et al. | 175/66 |
| 6,932,169 | B2 * | 8/2005 | Wylie et al. | 175/66 |
| 7,033,124 | B2 | 4/2006 | Snowdon | |
| 7,124,605 | B2 | 10/2006 | Parro et al. | |
| 7,128,169 | B2 | 10/2006 | Massetti et al. | |
| 7,175,716 | B2 * | 2/2007 | Tunnicliffe et al. | 134/11 |
| 8,207,738 | B2 | 6/2012 | Wang | |
| 2004/0065353 | A1 | 4/2004 | Tunnicliffe et al. | |
| 2004/0195152 | A1 | 10/2004 | Massetti et al. | |
| 2004/0195153 | A1 * | 10/2004 | Massetti et al. | 209/18 |
| 2005/0257809 | A1 | 11/2005 | Fedegari et al. | |
| 2007/0187432 | A1 | 8/2007 | Snowdon | |

FOREIGN PATENT DOCUMENTS

| | | | |
|---|---|---|---|
| GB | 2396374 | A | 6/2004 |
| WO | 2396374 | * | 6/2004 |
| WO | 2009084813 | A1 | 7/2009 |

OTHER PUBLICATIONS

Eldridge, Bruce , "Oil Contaminant Removal from Drill Cuttings by Supercritical Extraction", Ind. Eng. Chem. Res., vol. 35 (6), 1996, pp. 1901-1905.

Fattori, et al., "Carbon Dioxide Extraction of Canola Seed: Oil Solubility and Effect of Seed", JAOCS, vol. 65 (6), Jun. 1988, pp. 968-974.

Canadian Examination Report of Canadian Application No. 2,776,627 dated Jul. 3, 2013.

Australian Examination Report of Australian Application No. 2010303478 dated Aug. 30, 2013.

Nagpal, et al., "Remediation of Flare Pit Soils Using Supercritical Extraction", J. Environ. Eng. Sci. 4 (2005) 307-318.

Odusanya, et al., "Treatment of Oil-Contaminated Drill Cuttings Using Supercritical Carbon Dioxide (SC CO2)", CSCE/EWRI of Environ. Eng. Conf. (2002) 1-10.

Reddy, et al., "Chemical Method for Cleanup of Produced Oil-Coated Solids From Oilwell Operations" 10th Ann. Tulsa Univ. Int. Petrol. Conf., Nov. 11-Nov. 14, 2003 XP008042085 Houston, TX, USA.

Saintpere, et al., "Supercritical CO2 Extraction Applied to Oily Drilling Cuttings", Proceedings of the 2000 SPE Annual Technical Conference and Exhibition, Oct. 1-4, Dallas, TX, SPE, SPE 63126.

Seaton, et al., "Recovery of Oil From Drilled Cuttings by Liquefied Gas Extraction", Proceedings of the 2005 SPE International Symposium on Oilfield Chemistry, Feb. 2-4, Houston, TX, SPE 92963.

Talvarides, et al., "Supercritical Fluid Technology for Remediation of PCB/PAH-Contaminated Soils/Sediments", Proceedings of the 2000 Conference on Hazardous Waste Research (2000) 1-17.

First Examination Report issued in New Zealand Patent Application No. 625772 dated Jun. 3, 2014, 1 page.

* cited by examiner

METHOD FOR HYDROCARBON REMOVAL AND RECOVERY FROM DRILL CUTTINGS

BACKGROUND OF INVENTION

1. Field of the Invention

Embodiments disclosed herein relate generally to a method for extracting hydrocarbons from drill cuttings. More specifically, embodiments disclosed herein relate to a method for extracting hydrocarbons from drill cuttings using liquid carbon dioxide. Most specifically still, embodiments disclosed herein relate to a method for extracting hydrocarbons from drill cuttings using liquid carbon dioxide at relatively low temperatures and pressures.

2. Background Art

In the drilling of wells, a drill bit is used to dig many thousands of feet into the earth's crust. Oil rigs typically employ a derrick that extends above the well drilling platform. The derrick supports joint after joint of drill pipe connected end to end during the drilling operation. As the drill bit is pushed further into the earth, additional pipe joints are added to the ever lengthening "string" or "drill string". Therefore, the drill string includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough for disposal. In some situations, for example with specific types of drilling mud, the drilling mud may not be reused and it must be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

In addition to shakers, various methods for removing hydrocarbons and contaminants from drill cuttings and drilling fluids have been employed. However, the high costs and plant construction complexity, significant energy waste, limited safety, especially when operating off-shore, and low efficiency have rendered such methods disadvantageous for extraction of hydrocarbons from drill cuttings.

Accordingly, there exists a continuing need for methods and systems for extracting hydrocarbons from drill cuttings.

SUMMARY OF INVENTION

The present invention relates to a system and a method for the extraction of hydrocarbons from drill cuttings in drilling mud. The system for extracting hydrocarbons from drill cuttings includes at least one extraction tank, a carbon dioxide tank fluidly connected to the at least one extraction tank, and at least one separation tank in fluid communication with the at least one extraction tank. The method for extracting hydrocarbons from drill cuttings consists of exposing the drill cuttings to liquid carbon dioxide, solubilizing hydrocarbons from the drill cuttings with the liquid carbon dioxide, heating the liquid carbon dioxide and the soluble hydrocarbons to convert liquid carbon dioxide to carbon dioxide vapor, separating the hydrocarbons from the carbon dioxide vapor, and collecting the separated hydrocarbons.

Other aspects and advantages of the invention will be apparent from the following description and the appended claims.

DETAILED DESCRIPTION

In one aspect, embodiments disclosed herein relate generally to methods for the extraction of hydrocarbons from drill cuttings. More specifically, some embodiments disclosed herein relate to methods for extraction of hydrocarbons from drill cuttings using liquid carbon dioxide. More specifically still, some embodiments disclosed herein relate to methods for extraction of hydrocarbons from drill cuttings using liquid carbon dioxide at low temperature and pressure.

Environmental concerns related to disposal of oil-contaminated drill cuttings requires increasingly efficient processes to clean oil-contaminated drill cuttings, which may also allow for recovery and reuse of otherwise costly drilling muds. In accordance with the present disclosure, the use of carbon dioxide as a solvent to solubilize hydrocarbons may provide for cleaner drill cuttings and allow for hydrocarbons to be recovered.

The solubility of hydrocarbons in liquid carbon dioxide is about 10 to 20 times greater at low process temperatures, for example, −5 to 0° C., and pressures of approximately 50 bar than at higher process temperatures, for example, 20 to 50° C. and pressures of approximately 50 bar or higher. The present disclosure takes advantage of the high solubility of hydrocarbons even at relatively low temperatures and pressures. For example, at a pressure of 50 bar and temperature of approximately −5° C., the solubility of hydrocarbons, such as those on drill cuttings, is about 0.877 g oil/g $CO_2$. At such relatively low temperatures, the drill cuttings are not frozen, thereby allowing for favorable mass transfer (i.e., the mixture of drill cuttings and liquid carbon dioxide is free flowing).

Figure 1:
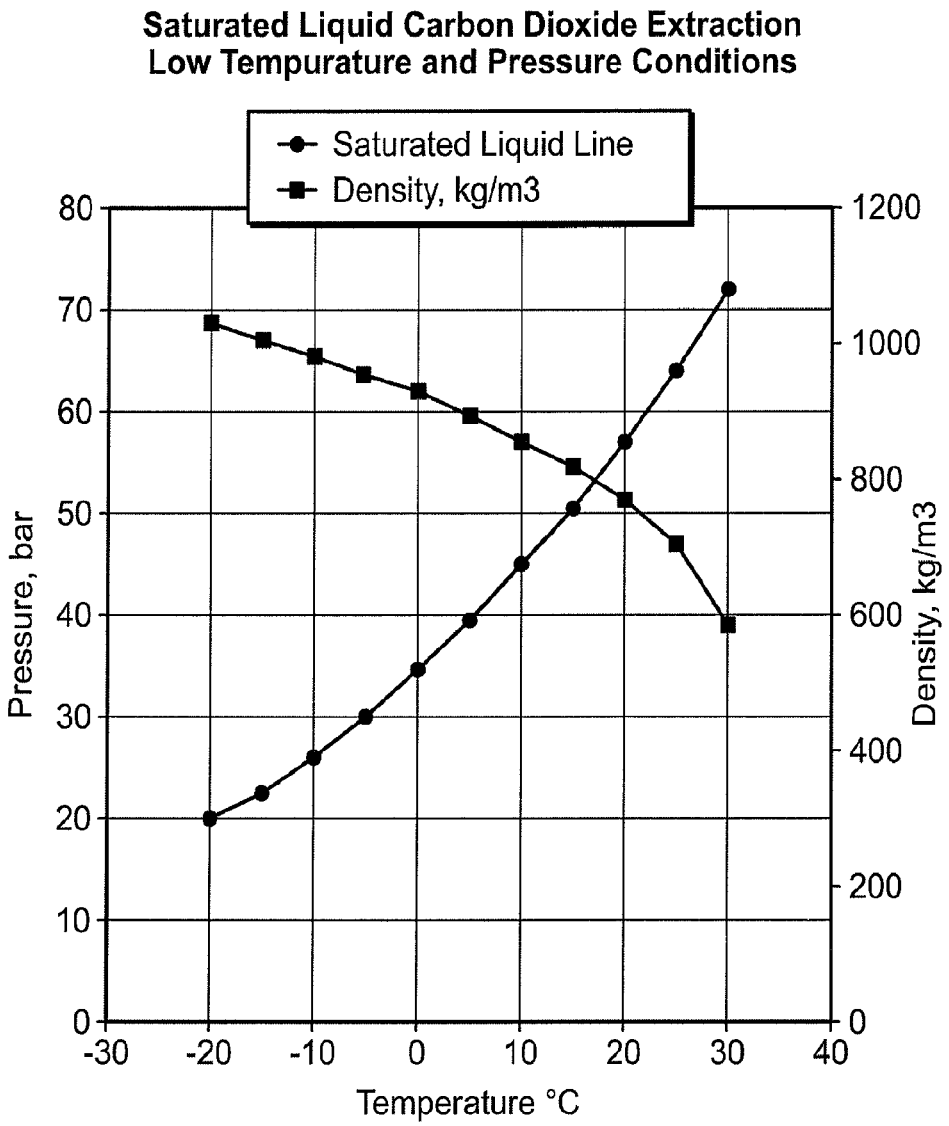
FIG. 1 is an illustration of a plot of pressure versus temperature including the extraction temperature/pressure region for liquid carbon dioxide in accordance with embodiments disclosed herein.

FIG. 1 shows a plot of pressure (bar) versus temperature (° C.) including the extraction temperature/pressure region for liquid carbon dioxide. As shown, extraction of hydrocarbons from drill cuttings using saturated liquid carbon dioxide may be accomplished at temperatures in the range of about −20° C. to about less than 20° C. and saturation pressures in the range of about 20 bar to about 45 bar. In alternate embodiments, the pressures may be in the range of about 45 bar to about 65 bar, between about 65 bar and about 85 bar, or between about 85 bar and about 105 bar. Carbon dioxide at temperatures below the saturation point may thus be used to remove hydrocarbons from drill cuttings. The saturation temperature of carbon dioxide is the temperature for a corresponding saturation pressure at which a liquid carbon dioxide boils into its vapor phase. Carbon dioxide at its saturation temperature will be present in both its liquid and gaseous forms. Carbon dioxide below the saturation temperature and corresponding pressure will only be in liquid form.

Figure 2:
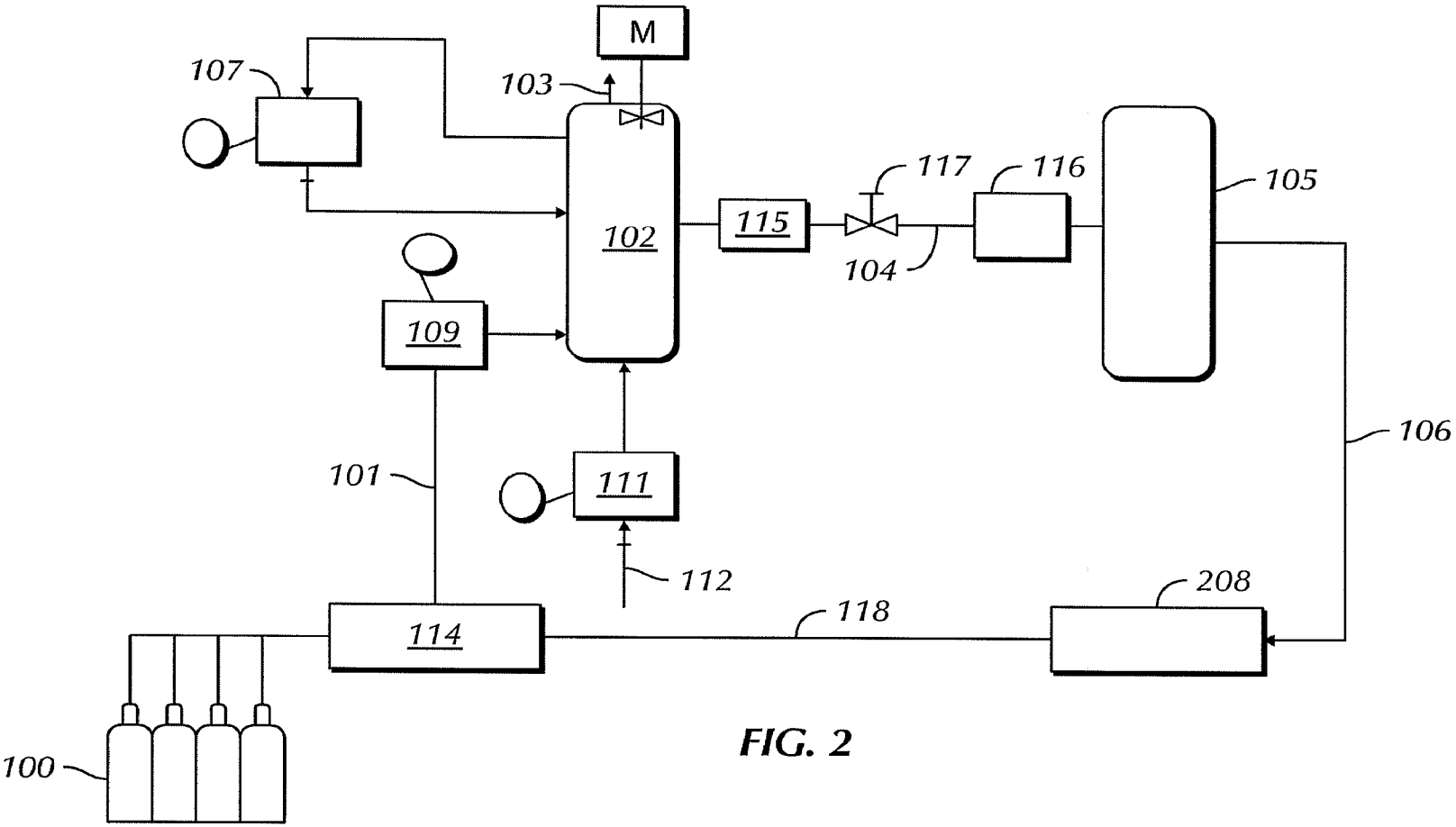
FIG. 2 is a schematic illustration of a system in accordance with embodiments disclosed herein.

FIG. 2 shows a schematic illustration of a system for extracting hydrocarbons from drill cuttings in accordance with embodiments disclosed herein. As shown, the system includes a carbon dioxide tank 100, which supplies liquid carbon to an extraction tank 102 via a transfer line 101. Those skilled in the art will appreciate that liquid carbon dioxide storage tanks may be manufactured using high-strength, fine-grain carbon steel, stainless steel, and other metals, or alloys thereof, constructed and tested for specific operating pressures. Transfer line 101 may be any type of conduit capable of transferring liquid carbon dioxide to the extraction tank 102 such as, for example, stainless steel and ceramic-lined stainless steel conduits. Those of ordinary skill in the art will appreciate that extraction tank 102 may be fabricated from materials known in the art, such as, for example, stainless steel, or other types of metal, or alloys thereof. In certain embodiments, the extraction tank may include a vessel capable of withstanding pressures above 50 bar. The extraction tank 102 may also include a purge valve or a nozzle 103 to periodically relieve pressure to prevent structural damage. The extraction tank 102 may also include a mechanical agitator M that may be used to agitate the drill cuttings in the extraction tank 102. Those of ordinary skill in the art will appreciate that the mechanical agitator M may be a helical, paddle, blade or any equivalent design that may rotate at a speed necessary to provide agitation of the drill cuttings. Mechanical agitator M may be disposed in or on extraction tank 102, so as to allow mechanical agitator M to contact and move the drill cuttings, increasing the exposure of the drill cuttings to liquid carbon dioxide. The extraction tank 102 may also include a recirculation pump 107 that may provide additional hydraulic mixing and fluidizing for enhanced rate of mass transfer in the extraction tank 102. Recirculation pump 107 may be used to recirculate liquid carbon dioxide through extraction tank 102 thereby increasing the saturation of carbon dioxide with hydrocarbons. Such a recirculation loop may thereby increase the efficiency of the system.

The dimensions of extraction tank 102 may also be varied in order to increase the efficiency of hydrocarbon removal. For example, in one embodiment the length-to-diameter ratio of extraction tank 102 may be about 2:1, while in other embodiments, the length-to-diameter ratio of extraction tank 102 may be about 52:1. In still other embodiments, the length-to-diameter ratio of extraction tank 102 may be about 3.7:1. Additionally, depending on the location of extraction tank 102, the extraction tank 102 may be disposed either vertically or horizontally.

In certain embodiments, a tank 109 may be used for supplying chemical additives. Those of ordinary skill in the art will appreciate that tank 109 may be fabricated from materials known in the art, such as, for example, stainless steel, other types of metal, or alloys thereof. Chemical additives from tank 109 may be injected to the extraction tank 102, or may be mixed with the carbon dioxide inline. In certain embodiments, a separate conduit may be used to provide chemical additives to the carbon dioxide stream or to extraction tank 102. Thus, while FIG. 1 shows addition of chemical additives inline, chemical additives may be added through various other means, such as through direct injection of a liquid additive, dosing of a solid additive, mixing a solid additive with liquid carbon dioxide and subsequent injection of the mixture into carbon dioxide stream or direct injection into extraction tank 109. Chemical additives that may be added include at least one of co-solvents, viscosity modifiers, surfactants, water, alcohols, polymethacrylate, hydrogenated styrene-diene copolymers, olefin copolymers, ethoxylated alcohols, styrene polyesters, or combinations thereof. Extraction tank 102 may include a pump 111 for transferring water via transfer line 112. Those of ordinary skill in the art will appreciate that tank 109 may be fabricated from materials known in the art, such as, for example, stainless steel, other types of metal, or alloys thereof. Transfer line 112 may be any type of conduit capable of transferring water to the extraction tank 102 such as, for example, stainless steel and ceramic-lined stainless steel conduits.

A supply of drill cuttings in extraction tank 102, having hydrocarbons thereon, may be treated with liquid carbon dioxide. After treating the drill cuttings with the liquid carbon dioxide, the hydrocarbons and liquid carbon dioxide may be transferred from extraction tank 102 via transfer line 104 to a duplex filtering system having a first tank 115 and a second tank 116 to remove any drill cuttings or residual particulate matter. Duplex filtering systems may also include various types of filtration media in order to separate out, for example, residual particulate matter from the hydrocarbon and liquid carbon dioxide stream. Similar to the extraction tank 102, the duplex filtering system may be manufactured from materials known in the art, such as, for example, stainless steel, other metals, or alloys thereof. Those of ordinary skill in the art will appreciate that while embodiments in accordance with the present disclosure may include a duplex filtering system having a first tank 115 and a second tank 116, certain embodiments may include one or more filtering systems having one or more tanks to remove any drill cuttings or particulate matter. A valve 117 may be disposed on the first tank 115 to control the flow of hydrocarbons and liquid carbon dioxide to the second tank 116. After treating and removing the drill cuttings, the hydrocarbons and liquid carbon dioxide mixture may be transferred to a separation tank 105 via line 104, which fluidly connects the duplex filtering system tanks 115 and 116 and the separation tank 105.

Transfer line 104 may be any type of conduit capable of carrying liquid carbon dioxide and hydrocarbons into the separation tank 105. Similar to extraction tank 102, separation tank 105 may be manufactured from materials known in the art, such as, for example, stainless steel, any other metal, or alloys thereof. Those of ordinary skill in the art will appreciate that hydrocarbons may subsequently be removed from the separation tank 105 via additional valves or piping (not shown). In certain embodiments, a carbon dioxide condenser 208 may be used to condense any carbon dioxide vapor that may have formed during the process. Those of ordinary skill in the art will appreciate that the carbon dioxide condenser 208 may be fabricated from materials known in the art, such as, for example, stainless steel, or other types of metal, or alloys thereof. Liquid carbon dioxide and carbon dioxide vapor from the separation tank 105 is transferred to the carbon dioxide condenser 208 via transfer line 106. The condensed liquid carbon dioxide from the carbon dioxide condenser 208 may be transferred to an additional liquid carbon dioxide storage tank 114 via transfer line 118 and then recycled for reuse. Those of ordinary skill in the art will appreciate that the additional liquid carbon dioxide storage tank 114 may be fabricated from materials known in the art, such as, for example, stainless steel, or other types of metal, or alloys thereof.

In operation, drill cuttings may be introduced into the extraction tank 102 through a variety of conveyance systems known in the art. The flow of drill cuttings therethrough may be processed continuously or in batches, depending on the requirements of a given operation. In continuous mode, drill cuttings may be processed by the continuous movement of drill cuttings and hydrocarbons from one stage to the next with extraction of hydrocarbons from drill cuttings, separation of hydrocarbons from carbon dioxide and recycling of carbon dioxide occurring simultaneously. In batch processing, drill cuttings may be processed in select quantities, for example, a selected quantity of drill cuttings may be processed, after which the operation is halted pending the requirement to process a subsequent quantity of cuttings.

Next, the hydrocarbons on the surface of drill cuttings dissolve in the liquid carbon dioxide in the extraction tank 102. The hydrocarbons and liquid carbon dioxide are then transferred to the duplex filtering system via transfer line 104 to remove residual particulate matter. The hydrocarbons and the liquid carbon dioxide are transferred to the separation tank 105 to allow collection and separation. After the carbon dioxide is separated from the hydrocarbons, the liquid carbon dioxide and carbon dioxide vapor that may have formed during the process may be transferred to the carbon dioxide condenser 208 and then to the liquid carbon dioxide storage tank 114 for subsequent reuse. At the end of the extraction cycle, residual liquid carbon dioxide may be present in extraction tank 102. Water may be pumped from 111 to the extraction tank 102 via transfer line 112 to displace residual liquid carbon dioxide from the extraction tank 102 to the liquid carbon dioxide storage tank 114. The addition of water to the extraction 102 may reduce the amount of carbon dioxide lost during depressurization of the extraction tank 102 and may further assist in slurrying and removal of drill cuttings from the extraction tank 102.

Figure 3:
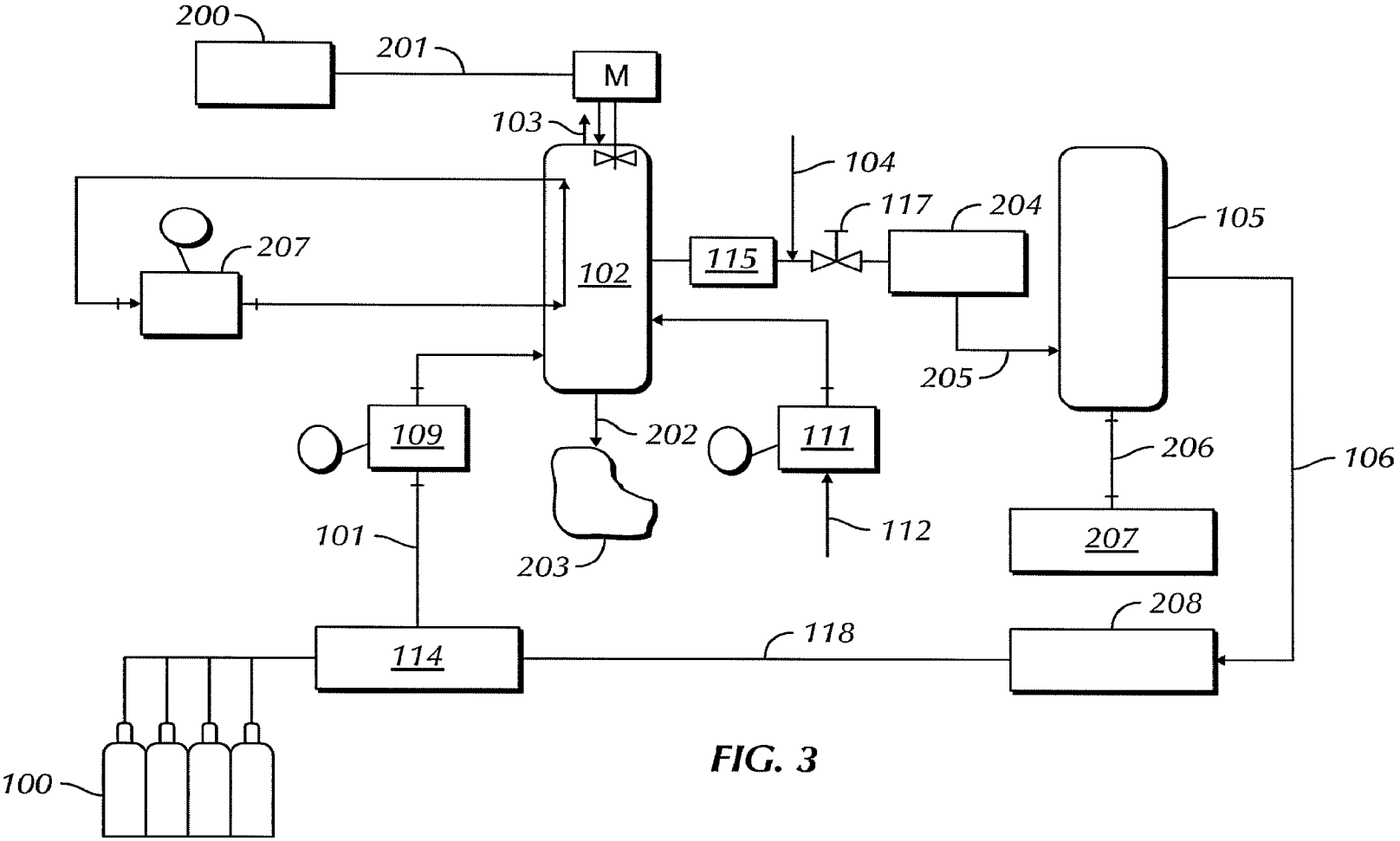
FIG. 3 is a schematic illustration of a system in accordance with embodiments disclosed herein.

Referring to FIG. 3, an alternate schematic illustration of a system for extracting hydrocarbons from drill cuttings in accordance with embodiments disclosed herein is shown, wherein like parts are represented by like reference numbers of FIG. 2. The system, as shown, includes a cuttings storage tank 200, wherein drill cuttings are stored and transferred to the extraction tank 102. Examples of storage tanks may include pits, collection vats, storage vessels, and reservoirs, which in certain embodiments, may exist as part of a rig infrastructure. The cuttings storage tank 200 is connected to the extraction tank 102 via the transfer line 201. Transfer line 201 may be any type of conduit capable of transferring drill cuttings to the extraction vessel 102. Such transfer lines 201 may also include conveyance devices such as augers, belts, or conduits capable of allowing pneumatic transference. Liquid carbon dioxide is transferred from the liquid carbon dioxide storage tank 100 to the extraction tank 102 via transfer line 101. The extraction tank may be periodically purged via opening purge valve 103 to relieve pressure, thereby preventing structural damage to the extraction tank. The extraction tank 102 also includes an outlet 202 for removing drill cuttings 203. The drill cuttings may pass through outlet 202 and may then be collected for disposal. The extraction tank 102 may include a mechanical agitator M to agitate the drill cuttings in the extraction tank 102. The extraction tank 102 may include a recirculation pump 107 that may also provide additional hydraulic mixing and fluidizing for enhanced rate of mass transfer in the extraction tank 102. In certain embodiments, a tank 109 may be used for supplying chemical additives. Chemical additives from tank 109 may be injected to the extraction tank 102, or may be mixed with the carbon dioxide inline. Chemical additives that may be added include at least one of co-solvents, viscosity modifiers, surfactants, water, alcohols, polymethacrylate, hydrogenated styrene-diene copolymers, olefin copolymers, ethoxylated alcohols, styrene polyesters, or combinations thereof. Extraction tank 102 may include a pump 111 for transferring water via transfer line 112. Those of ordinary skill in the art will appreciate that tank 109 may be fabricated from materials known in the art, such as, for example, stainless steel, other types of metal, or alloys thereof. Transfer line 112 may be any type of conduit capable of transferring water to the extraction tank 102 such as, for example, stainless steel and ceramic-lined stainless steel conduits.

In this embodiment, the hydrocarbons and liquid carbon dioxide may be transferred from the extraction tank 102 via transfer line 104 to a filtering system 115 to remove residual drill cuttings or particulate matter from the hydrocarbon and carbon dioxide mixture. Similar to the extraction tank 102, the filtering system 115 may be manufactured from materials known in the art, such as, for example, stainless steel, other metals, or alloys thereof. Those of ordinary skill in the art will appreciate that certain embodiments may include one or more filtering systems having one or more tanks to remove residual drill cuttings or particulate matter from the hydrocarbon and carbon dioxide mixture. A valve 117 may be disposed on the filtering system 115 to control the flow of hydrocarbons and liquid carbon dioxide to the separation tank 105. In this embodiment, transfer line 104 is fluidly connected to a carbon dioxide heater 204 for converting liquid carbon dioxide into carbon dioxide vapor. The carbon dioxide heater 204 is fluidly connected to the separation tank 105 via transfer line 205. The separation tank 105 may also have an outlet 206 for removing hydrocarbons to a hydrocarbon collection tank 207.

Liquid carbon dioxide and carbon dioxide vapor mixture from the separation tank 105 may be transferred to the carbon dioxide condenser 208 via transfer line 106. After condensing carbon dioxide vapor, the liquid carbon dioxide may be transferred to the additional liquid carbon dioxide storage tank 114 via transfer line 118 and then recycled for subsequent use.

During operation, the drill cuttings are introduced into the extraction tank 102 from the cuttings storage tank 200 via transfer line 201 through a variety of conveyance systems known in the art. The flow of drill cuttings may be transferred at a constant rate or in batches, depending on the requirements of a given operation. Liquid carbon dioxide is then transferred to the extraction tank 102 via transfer line 101. In the extraction tank 102, the hydrocarbons on the surface of drill cuttings dissolve in the liquid carbon dioxide. Clean drill cuttings 203 may then be removed from the extraction tank 102 through the outlet 202.

Next, the liquid carbon dioxide stream with dissolved hydrocarbons from drill cuttings is transferred to the filtering system 115 via transfer line 104 to remove residual drill cuttings and/or particulate matter. The hydrocarbons and liquid carbon dioxide are then transferred to the carbon dioxide heater 204, where the liquid carbon dioxide is heated to form carbon dioxide vapor, thereby releasing the soluble hydrocarbons in the carbon dioxide heater 204. The hydrocarbons and the carbon dioxide vapor are then transported to the separation tank 105 via transfer line 205. Hydrocarbons may then be removed from the separation tank 105 through the outlet 206 into the collection tank 207. The hydrocarbons may be removed for reuse from the separation tank 105 through the outlet 206 through a variety of systems known in the art. The carbon dioxide vapor is then transferred to the carbon dioxide condenser 208, wherein the carbon dioxide vapor is cooled to form liquid carbon dioxide. The liquid carbon dioxide is transferred to the additional liquid carbon dioxide tank 114 which is then recycled for subsequent use. At the end of the extraction cycle, residual liquid carbon dioxide may be present in the extraction tank 102. Water may be pumped from 111 to the extraction tank 102 via transfer line 112 to displace residual liquid carbon dioxide from the extraction tank 102 to the liquid carbon dioxide storage tank 114. The addition of water to the extraction 102 may reduce the amount of carbon dioxide lost during depressurization of the extraction tank 102 and may further assist in slurrying and removal of drill cuttings from the extraction tank 102.

Figure 4:
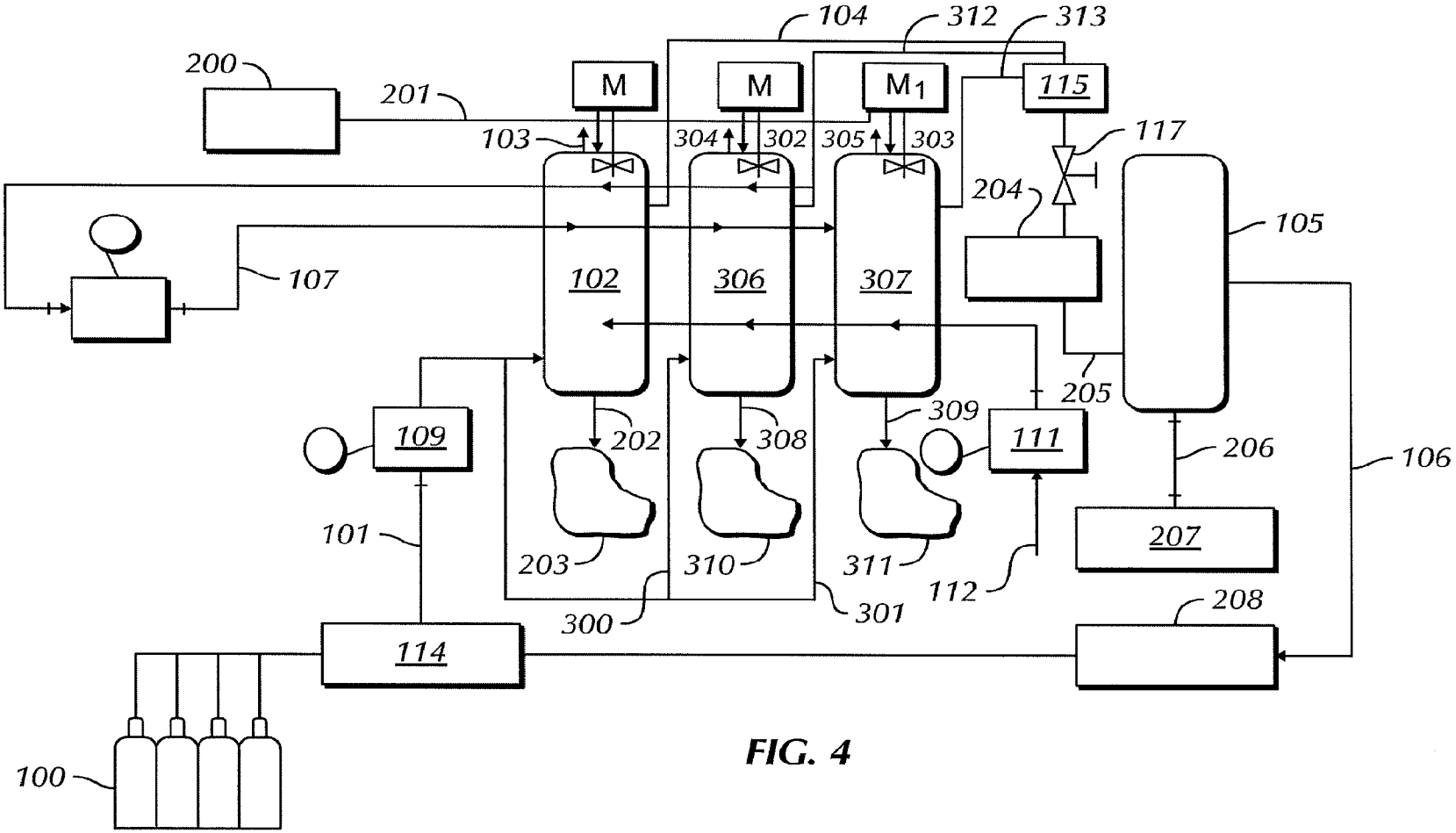
FIG. 4 is a schematic illustration of a system in accordance with embodiments disclosed herein.

Referring to FIG. 4, an alternate schematic illustration of a system for extracting hydrocarbons from drill cuttings in accordance with embodiments disclosed herein is shown, wherein like parts are represented by like reference numbers of FIGS. 1 and 2. The system, as shown, includes a cuttings storage tank 200, wherein drill cuttings are stored and transferred to the extraction tanks 102, 306 and 307. The cuttings storage tank 200 is connected to the extraction tanks 102, 306 and 307 via the transfer lines 201, 302 and 303. Liquid carbon dioxide is transferred from the liquid carbon dioxide storage tank 100 to the extraction tanks 102, 306 and 307 via transfer lines 101, 300 and 301. The extraction tanks may be periodically purged via opening purge valves 103, 304 and 305 to relieve pressure, thereby preventing any structural damage to the extraction tank.

The extraction tanks 102, 306 and 307 also include outlets 202, 308 and 309, respectively, for removing cleaned drill cuttings 203, 310 and 311. The drill cuttings may pass through outlets 202, 308 and 309 and may then be collected for disposal. The extraction tanks 102, 306 and 307 may include mechanical agitators M to agitate the drill cuttings in the extraction tanks 102, 306 and 307. Those of ordinary skill in the art will appreciate that the mechanical agitator M may be a helical, paddle, blade or any equivalent design that may rotate at a speed necessary to provide agitation of the drill cuttings. The extraction tanks 102, 306 and 307 may also include a recirculation pump 107 that may provide additional hydraulic mixing and fluidizing for enhanced rate of mass transfer in the extraction tank 102. In certain embodiments, a tank 109 may be used for supplying chemical additives. Chemical additives from tank 109 may be injected to the extraction tank 102, or may be mixed with the carbon dioxide inline. Chemical additives that may be added include at least one of co-solvents, viscosity modifiers, surfactants, water, alcohols, polymethacrylate, hydrogenated styrene-diene copolymers, olefin copolymers, ethoxylated alcohols, styrene polyesters, or combinations thereof. Extraction tank 102 may include a pump 111 for transferring water via transfer line 112. Those of ordinary skill in the art will appreciate that tank 109 may be fabricated from materials known in the art, such as, for example, stainless steel, other types of metal, or alloys thereof. Transfer line 112 may be any type of conduit capable of transferring water to the extraction tank 102 such as, for example, stainless steel and ceramic-lined stainless steel conduits.

Transfer lines 104, 312 and 313 are fluidly connected to a filtering system 115. Hydrocarbons and liquid carbon dioxide are transferred to the filtering 115 system via transfer lines 104, 312 and 313 to remove residual drill cuttings and/or particulate matter. Those of ordinary skill in the art will appreciate that certain embodiments may include one or more filtering systems having one or more tanks to remove any drill cuttings or residual particulate matter. A valve 117 may be disposed on the filtering system 115 to control the flow of hydrocarbons and liquid carbon dioxide to the carbon dioxide heater 204. The hydrocarbons and liquid carbon dioxide are then transferred to the carbon dioxide heater 204 for converting liquid carbon dioxide into carbon dioxide vapor. The carbon dioxide heater 204 is fluidly connected to the separation tank 105 via transfer line 205. The separation tank 105 may also have an outlet 206 for removing hydrocarbons to a hydrocarbon collection tank 207. Separation tank 105 is also connected to the carbon condenser 208 via a transfer line 106. The condensed carbon dioxide is then transferred to the additional carbon dioxide storage tank 114 and recycled for subsequent reuse.

During operation, the drill cuttings are introduced into extraction tanks 102, 306 and 307 from the cuttings storage tank 200 via transfer lines 201, 302 and 303 through a variety of conveyance systems known in the art. Water may be pumped from 111 to the extraction tank 102 via transfer line 112. The flow of drill cuttings may be transferred at a constant rate or in batches, as described above. Contaminated drill cuttings have substantial amounts of hydrocarbons on the surface. In the extraction tanks 102, 306 and 307 the hydrocarbons on the surface of drill cuttings dissolve in the liquid carbon dioxide. Clean drill cuttings 203, 310 and 311 may then be removed from the extraction tanks 102, 306 and 307, respectively, through outlets 202, 308 and 309. Next, the liquid carbon dioxide stream with dissolved hydrocarbons from drill cuttings is transferred to the filtering system 115 to remove any residual particulate matter. The hydrocarbons and liquid carbon dioxide are then transferred to the carbon dioxide heater 204, where the liquid carbon dioxide is heated to form carbon dioxide vapor, thereby releasing the soluble hydrocarbons in the carbon dioxide heater 204. The hydrocarbons and the carbon dioxide vapor are transferred to the separation tank 105 via transfer line 205. Hydrocarbons are removed from the separation tank 105 through the outlet 206 into the collection tank 207. The hydrocarbons may be removed for reuse from the separation tank 105 through the outlet 206 through a variety of systems known in the art. The carbon dioxide vapor may then be transferred to a carbon dioxide condenser 208, wherein the carbon dioxide vapor is cooled to form liquid carbon dioxide, which is then recycled for subsequent use. In some embodiments, the system may include a plurality of separation tanks. The plurality of separation tanks may be discretely connected to the carbon dioxide heater 204 via multiple transfer lines and the hydrocarbons may be removed from each of the separation tanks. In other embodiments, the plurality of separation tanks may be connected in series such that fluid travels from the carbon dioxide heater 204 through at least two separation tanks and the hydrocarbons may be removed from each of the separation tanks. At the end of the extraction cycle, residual liquid carbon dioxide may be present in the extraction tank 102. Water may be pumped from 111 to the extraction tank 102 via transfer line 112 to displace residual liquid carbon dioxide from the extraction tank 102 to the liquid carbon dioxide storage tank 114. The addition of water to the extraction 102 may reduce the amount of carbon dioxide lost during depressurization of the extraction tank 102 and may further assist in slurrying and removal of drill cuttings from the extraction tank 102.

In accordance with embodiments described above, the drill cuttings stored in the cuttings storage vessel may be dry or may be wet. Wet cuttings contain water and/or oil, and as such, may be free flowing, non-free flowing, or pasty. In certain embodiments, the drill cuttings may be pre-dried by a vortex dryer to produce substantially dry drill cuttings which, in some aspects, may be free flowing solids, which abide by the laws of Newtonian flow.

As described above, methods according to the present disclosure use liquid carbon dioxide at a pressure of at least 50 bar. In some embodiments, the methods may include using liquid carbon dioxide at pressures ranging from between about 0 bar to about 50 bar. In still other embodiments, the methods may include using liquid carbon dioxide at pressures above 50 bar. In particular embodiments disclosed herein, methods may include utilizing carbon dioxide at a temperature of less than 10° C., wherein in other embodiments, the method may include using liquid carbon dioxide at temperatures between about −20° C. to less than 20° C.

In accordance with embodiments described above, the methods may include adding viscosity modifiers to alter the viscosity of drill cuttings in liquid carbon dioxide wherein the viscosity modifiers may include, for example, polymethacrylate (PMA), hydrogenated styrene-diene copolymers, olefin copolymers, styrene polyesters, and the like.

In accordance with embodiments described above, the methods may include adding additives such as co-solvents, viscosity modifiers, surfactants, and combinations thereof, which may be added to either the cuttings or liquid carbon dioxide to alter the behavior of the drill cuttings in the liquid carbon dioxide. In accordance with embodiments described above, the additives may include, for example, water, alcohol, polymethacrylate, hydrogenated styrene-diene copolymers, olefin copolymers, ethoxalated alcohols, styrene polyesters, and combinations thereof.

In accordance with embodiments disclosed above, the methods may provide for decreased energy costs for processing. For example, the energy required for extracting hydrocarbons from about 100 kg drill cuttings with about 15 weight % oil using liquid carbon dioxide is about 30 kW at about 5° C. and about 50 bar as opposed to about 360 kW at about 25° C. and about 70 bar. The energy requirement for thermal desorption may be as much as or greater than about 800 kW at about 500° C.

Figure 5:
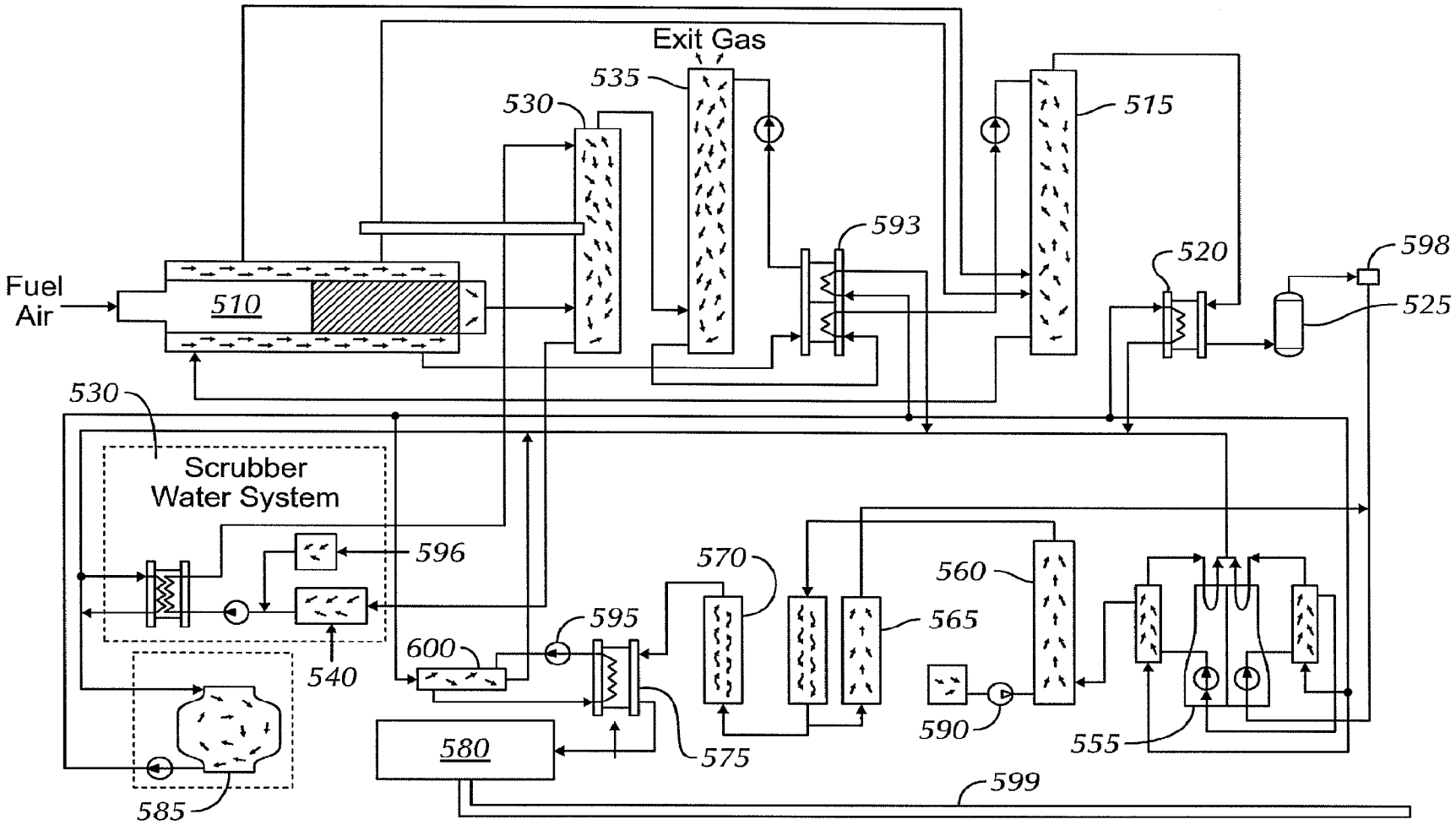
FIG. 5 is a schematic illustration of a power generation and carbon dioxide collection system in accordance with embodiments disclosed herein.

Referring to FIG. 5, a power generation and carbon dioxide recovery system according to embodiments of the present disclosure is shown. Such systems may be installed on an offshore rig, thereby providing a method for extracting hydrocarbons from cuttings. An offshore rig may have a diesel generator as part of the initial rig infrastructure. A byproduct of power generation from diesel generators and/or boiler systems is carbon dioxide; however, the byproducts of power generation may result in relatively low carbon dioxide content.

To recover carbon dioxide from streams having a low carbon dioxide content, such as a boiler flue gas stream, one solution is to scrub the gas mixture which is lean in carbon dioxide with a suitable solvent, such as water, monoethanolamine, sulfolane or potassium carbonate, to dissolve the carbon dioxide and then to strip the carbon dioxide from the solution so obtained; i.e., another fluid is introduced into the system in order to achieve the necessary separation. The carbon dioxide can then be compressed, dried, cooled and further purified by partial condensation or distillation. Various other processes to recover and/or purify carbon dioxide are disclosed in U.S. Pat. Nos. 4,602,477, 4,639,257, 4,762,543, 4,936,887, 6,070,431, and 7,124,605, among others.

After the carbon dioxide is captured, compressed, dried, cooled, and treated, the carbon dioxide may then be stored for further use on the rig, such as through hydrocarbon extraction methods described above. FIG. 5 shows one method of recovering carbon dioxide as a byproduct of power generation and reuse of the carbon dioxide in a hydrocarbon extraction method. As illustrated, a fuel and air mixture may be introduced into a boiler 510, thereby resulting in the production of various gases that may be transferred to a scrubber tower 530. In scrubber tower 530 a caustic wash may be used to remove acidic species. A portion of the case including carbon dioxide may then be transferred to an adsorber tower 535, wherein carbon dioxide may be dissolved to separate various gases, such as, for example, nitrogen, oxygen, and methane. The carbon dioxide may then be transferred to a heat exchanger 597, where the carbon dioxide is converted to a liquid phase. The liquid carbon dioxide may then be transferred to a stripper tower 515, where carbon dioxide is stripped from solvents. The gas phase carbon dioxide may then be transferred to a gas cooler 520 and a condensate separator 525.

Certain produced acids separated in scrubber tower 530 may be transferred through a scrubber water tank and pump 540 wherein various caustic agents may be pumped from caustic tank 545. The treated acids may then be pumped through one or more coolers 550 and back to scrubber tower 530.

Captured carbon dioxide may be pumped through one or more compressors 555 from condensate separator 525, through a purifier 560 and dried 565, prior to passing through a carbon filter 570 and recompressed via condenser 575. The compressed liquid carbon dioxide may then be stored in storage tank 580 for eventual use in extracting hydrocarbons from drill cuttings. Those of ordinary skill in the art will appreciate that various methods of separating and condensing carbon dioxide may be used. Certain systems may include multiple steps of compression, drying, purification, etc. prior to storing the carbon dioxide on for hydrocarbon extraction. As illustrated in FIG. 5, such system may include various other components, such as one or more cooling towers 585, charge pumps 590, refrigerant pumps 595, refrigerant condensers 596, and the like. Such recovery systems may further include various pressure release valves 598, and other pumps that may be required depending on the specific design aspects of the operation. Examples of carbon dioxide generators and recovery systems that may also be used according to embodiments of the present disclosure include systems commercially available from Buse Gastek GmbH & Co. KG, Germany.

After the carbon dioxide is captured and processed, the carbon dioxide may be used in hydrocarbon extraction systems, such as those described in FIGS. 2-3, above. Carbon dioxide may be transferred from carbon dioxide storage tank 580 via conduit 599. In certain embodiments, additional sources of carbon dioxide may be used, such as, for example, gas generated during drilling.

In still other embodiments, the introduction of cuttings to the extraction vessel may be facilitated through the use of one or more pressurized vessels. Thus, pressurized vessels that may already be available on an offshore rig may be used to transfer cuttings to be treated from a storage location to the extraction vessel. Additionally, pressurized vessels may be used to store and/or transfer treated cuttings. Examples of pressurized vessels that may be used according to embodiments of the present disclosure are explained in detail below.

Figure 6A:
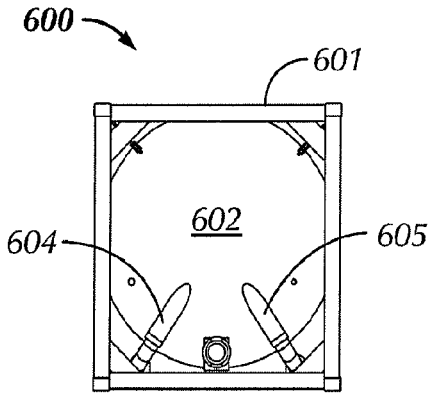
FIGS. 6A-6C are various views of pressurized vessels in accordance with embodiments disclosed herein.
Figure 6B:
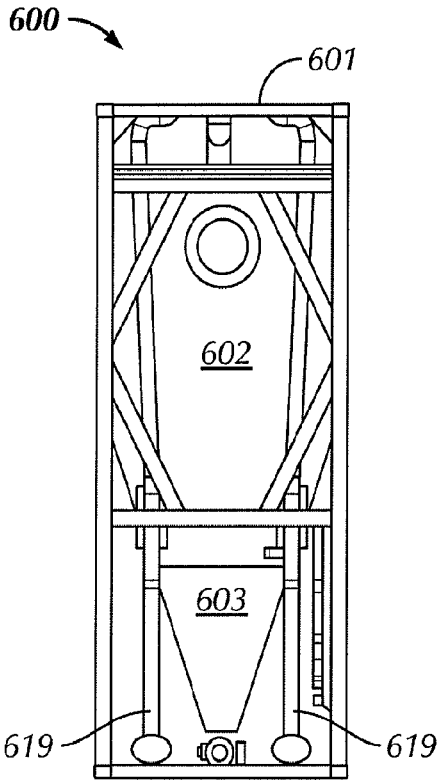
Figure 6C:
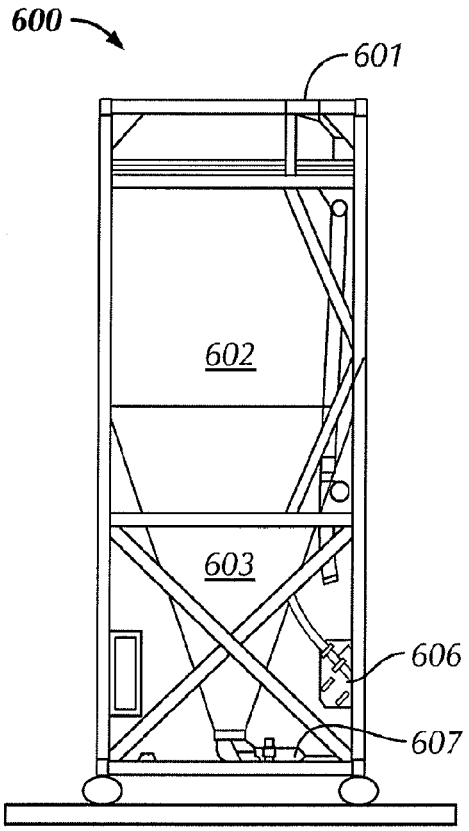

Referring to FIGS. 6A through 6C, a pressurized vessel, also referred to as a pressurized container, pressurized cuttings storage vessel, or in certain embodiments a cuttings storage vessel, according to embodiments of the present disclosure, is shown. Those of ordinary skill in the art will appreciate that as referred to herein, a pressurized container, pressurized cuttings storage vessel, and a cuttings storage vessel may be used interchangeably and according to the description in this section.

FIG. 6A is a top view of a pressurized container, while FIGS. 6B and 6C are side views. One type of pressurized vessel that may be used according to aspects disclosed herein includes an ISO-PUMP™, commercially available from M-I LLC, Houston, Tex. In such an embodiment, a pressurized container 600 may be enclosed within a support structure 601. Support structure 601 may hold pressurized container 600 to protect and/or allow the transfer of the container from, for example, a supply boat to a production platform. Generally, pressurized container 600 includes a vessel 602 having a lower angled section 603 to facilitate the flow of materials between pressurized container 600 and other processing and/or transfer equipment (not shown). A further description of pressurized containers 600 that may be used with embodiments of the present disclosure is discussed in U.S. Pat. No. 7,033,124, assigned to the assignee of the present application, and hereby incorporated by reference herein. Those of ordinary skill in the art will appreciate that alternate geometries of pressurized containers 600, including those with lower sections that are not conical, may be used in certain embodiments of the present disclosure.

Pressurized container 600 also includes a material inlet 604 for receiving material, as well as an air inlet and outlet 605 for injecting air into the vessel 602 and evacuating air to atmosphere during transference. Certain containers may have a secondary air inlet 606, allowing for the injection of small bursts of air into vessel 602 to break apart dry materials therein that may become compacted due to settling. In addition to inlets 604, 605, and 606, pressurized container 600 includes an outlet 607 through which dry materials may exit vessel 602. The outlet 607 may be connected to flexible hosing, thereby allowing pressurized container 600 to transfer materials between pressurized containers 600 or containers at atmosphere.

Figure 7A:
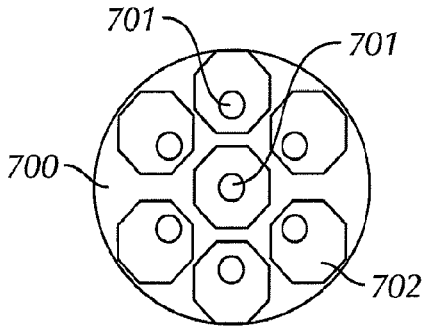
FIGS. 7A-7D are various views of pressurized vessels in accordance with embodiments disclosed herein.
Figure 7B:
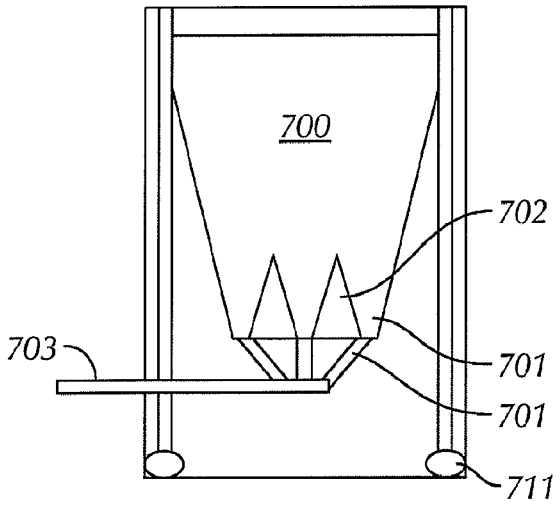
Figure 7C:
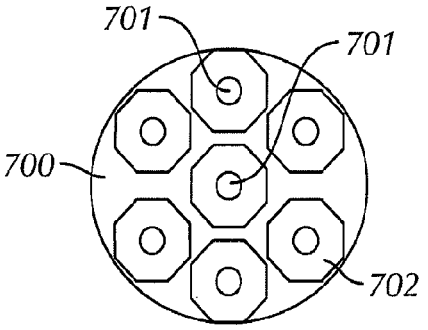
Figure 7D:
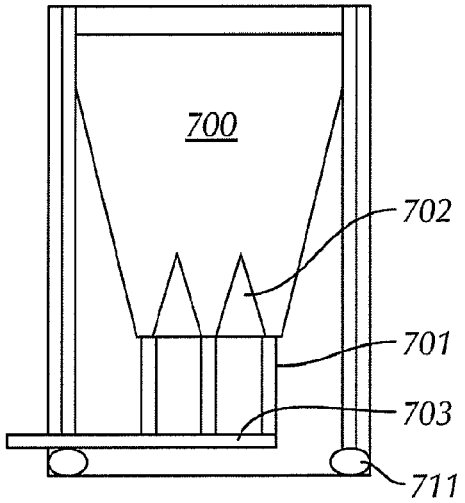

Referring to FIGS. 7A through 7D, a pressurized container 700 according to embodiments of the present disclosure is shown. FIGS. 7A and 7B show top views of the pressurized container 700, while FIGS. 7C and 7D show side views of the pressurized container 700.

Referring now specifically to FIG. 7A, a top schematic view of a pressurized container 700 according to an aspect of the present disclosure is shown. In this embodiment, pressurized container 700 has a circular external geometry and a plurality of outlets 701 for discharging material therethrough. Additionally, pressurized container 700 has a plurality of internal baffles 702 for directing a flow of to a specific outlet 701. For example, as materials are transferred into pressurized container 700, the materials may be divided into a plurality of discrete streams, such that a certain volume of material is discharged through each of the plurality of outlets 701. Thus, pressurized container 700 having a plurality of baffles 702, each corresponding to one of outlets 701, may increase the efficiency of discharging materials from pressurized container 500.

During operation, materials transferred into pressurized container 700 may exhibit plastic behavior and begin to coalesce. In traditional transfer vessels having a single outlet, the coalesced materials could block the outlet, thereby preventing the flow of materials therethrough. However, the present embodiment is configured such that even if a single outlet 701 becomes blocked by coalesced material, the flow of material out of pressurized container 700 will not be completely inhibited. Moreover, baffles 702 are configured to help prevent materials from coalescing. As the materials flow down through pressurized container 700, the material will contact baffles 702, and divide into discrete streams. Thus, the baffles that divide materials into multiple discrete steams may further prevent the material from coalescing and blocking one or more of outlets 701.

Referring to FIG. 7B, a cross-sectional view of pressurized container 700 from FIG. 7A according to one aspect of the present disclosure is shown. In this aspect, pressurized container 700 is illustrated including a plurality of outlets 701 and a plurality of internal baffles 702 for directing a flow of material through pressurized container 700. In this aspect, each of the outlets 701 are configured to flow into a discharge line 703. Thus, as materials flow through pressurized container 700, they may contact one or more of baffles 702, divide into discrete streams, and then exit through a specific outlet 701 corresponding to one or more of baffles 702. Such an embodiment may allow for a more efficient transfer of material through pressurized container 700.

Referring now to FIG. 7C, a top schematic view of a pressurized container 700 according to one embodiment of the present disclosure is shown. In this embodiment, pressurized container 700 has a circular external geometry and a plurality of outlets 701 for discharging materials therethrough. Additionally, pressurized container 700 has a plurality of internal baffles 722 for directing a flow of material to a specific one of outlets 701. For example, as materials are transferred into pressurized container 700, the material may be divided into a plurality of discrete streams, such that a certain volume of material is discharged through each of the plurality of outlets 701. Pressurized container 700 having a plurality of baffles 702, each corresponding to one of outlets 701, may be useful in discharging materials from pressurized container 700.

Referring to FIG. 7D, a cross-sectional view of pressurized container 700 from FIG. 7C according to one aspect of the present disclosure is shown. In this aspect, pressurized container 700 is illustrated including a plurality of outlets 701 and a plurality of internal baffles 502 for directing a flow of materials through pressurized container 700. In this embodiment, each of the outlets 701 is configured to flow discretely into a discharge line 703. Thus, as materials flow through pressurized container 7500, they may contact one or more of baffles 702, divide into discrete streams, and then exit through a specific outlet 701 corresponding to one or more of baffles 702. Such an embodiment may allow for a more efficient transfer of materials through pressurized container 700.

Because outlets 701 do not combine prior to joining with discharge line 703, the blocking of one or more of outlets 701 due to coalesced material may be further reduced. Those of ordinary skill in the art will appreciate that the specific configuration of baffles 702 and outlets 701 may vary without departing from the scope of the present disclosure. For example, in one embodiment, a pressurized container 700 having two outlets 701 and a single baffle 702 may be used, whereas in other embodiments a pressurized container 700 having three or more outlets 701 and baffles 702 may be used. Additionally, the number of baffles 702 and/or discrete stream created within pressurized container 700 may be different from the number of outlets 701. For example, in one aspect, pressurized container 700 may include three baffles 702 corresponding to two outlets 701. In other embodiments, the number of outlets 701 may be greater than the number of baffles 702.

Moreover, those of ordinary skill in the art will appreciate that the geometry of baffles 702 may vary according to the design requirements of a given pressurized container 700. In one aspect, baffles 702 may be configured in a triangular geometry, while in other embodiments, baffles 702 may be substantially cylindrical, conical, frustoconical, pyramidal, polygonal, or of irregular geometry. Furthermore, the arrangement of baffles 702 in pressurized container 700 may also vary. For example, baffles 702 may be arranged concentrically around a center point of the pressurized container 700, or may be arbitrarily disposed within pressurized container 700. Moreover, in certain embodiments, the disposition of baffles 702 may be in a honeycomb arrangement, to further enhance the flow of materials therethrough.

Those of ordinary skill in the art will appreciate that the precise configuration of baffles 702 within pressurized container 700 may vary according to the requirements of a transfer operation. As the geometry of baffles 702 is varied, the geometry of outlets 701 corresponding to baffles 702 may also be varied. For example, as illustrated in FIGS. 7A-7D, outlets 701 have a generally conical geometry. In other embodiments, outlets 701 may have frustoconical, polygonal, cylindrical, or other geometry that allows outlet 701 to correspond to a flow of material in pressurized container 702.

Figure 8A:
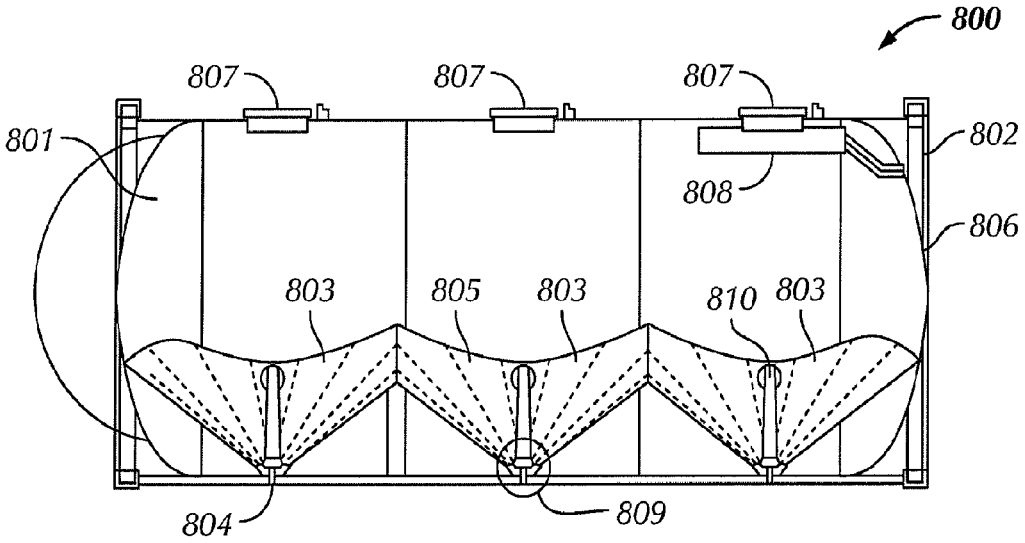
FIGS. 8A-8B are various views of pressurized vessels in accordance with embodiments disclosed herein.
Figure 8B:
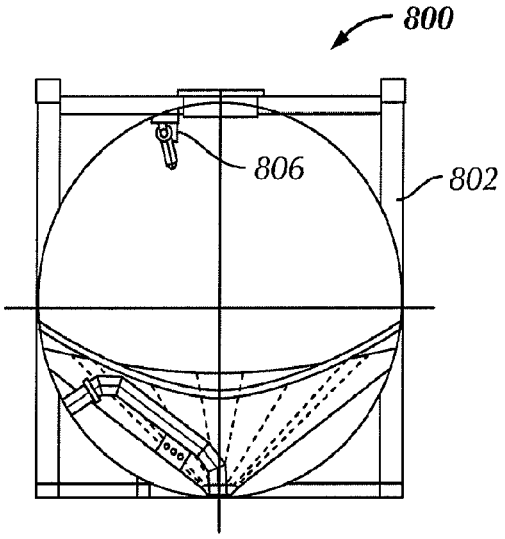

Referring now to FIGS. 8A through 8B, alternate pressurized containers according to aspects of the present disclosure are shown. Specifically, FIG. 8A illustrates a side view of a pressurized container, while FIG. 8B shows an end view of a pressurized container.

In this aspect, pressurized container 800 includes a vessel 801 disposed within a support structure 802. The vessel 801 includes a plurality of conical sections 803, which end in a flat apex 804, thereby forming a plurality of exit hopper portions 805. Pressurized container 800 also includes an air inlet 806 configured to receive a flow of air and material inlets 807 configured to receive a flow of materials. During the transference of materials to and/or from pressurized container 800, air is injected into air inlet 806, and passes through a filtering element 808. Filtering element 808 allows for air to be cleaned, thereby removing dust particles and impurities from the airflow prior to contact with the material within the vessel 801. A valve 809 at apex 804 may then be opened, thereby allowing for a flow of materials from vessel 801 through outlet 810. Examples of horizontally disposed pressurized containers 800 are described in detail in U.S. Patent Publication No. 2007/0187432 to Brian Snowdon, and is hereby incorporated by reference.

Figure 9:
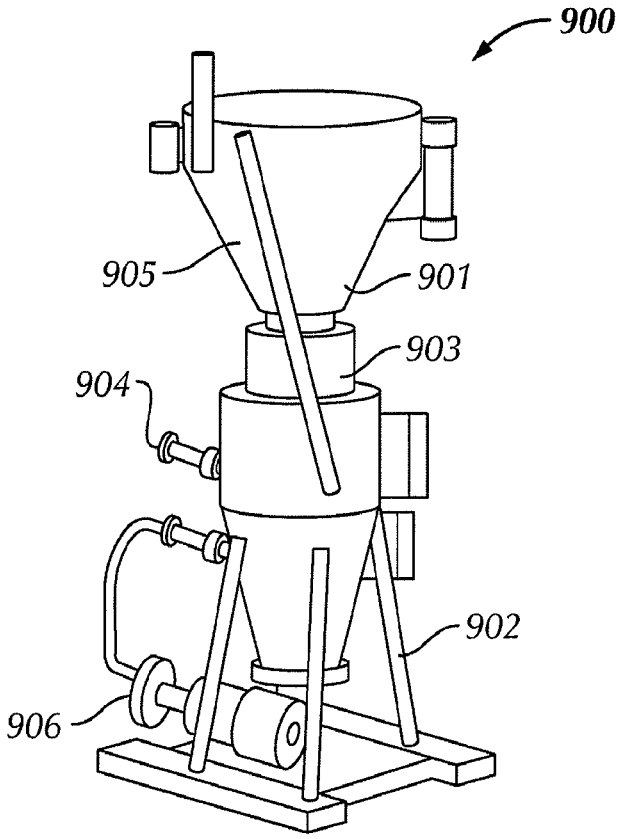
FIG. 9 is a perspective view of a pressurized vessel in accordance with embodiments disclosed herein.

Referring now to FIG. 9, a pressurized transference device, according to embodiments of the present disclosure, is shown. Pressurized transference device 900 may include a feed chute 901 through which materials may be gravity fed. After the materials have been loaded into the body 902 of the device, an inlet valve 903 is closed, thereby creating a pressure-tight seal around the inlet. Once sealed, the body is pressurized, and compressed air may be injected through air inlet 904, such that the dry material in body 902 is discharged from the pressurized transference device in a batch. In certain aspects, pressurized transference device 900 may also include secondary air inlet 905 and/or vibration devices (not shown) disposed in communication with feed chute 901 to facilitate the transfer of material through the feed chute 901 by breaking up coalesced materials.

During operation, the pressurized transference device 900 may be fluidly connected to pressurized containers, such as those described above, thereby allowing materials to be transferred therebetween. Because the materials are transferred in batch mode, the materials travel in slugs, or batches of material, through a hose connected to an outlet 906 of the pressurized transference device. Such a method of transference is a form of dense phase transfer, whereby materials travel in slugs, rather than flow freely through hoses, as occurs with traditional, lean phase material transfer.

EXAMPLES

The following examples illustrate embodiments of the present disclosure and may provide meaningful comparisons illustrating the advantages of the method and system according to the present disclosure.

A pilot plant was built with two test vessels in order to determine operational parameters for removing hydrocarbons from cuttings using liquid carbon dioxide. One vessel had a 26 liter capacity and a length to diameter ratio (L:D) of 2:1. The second vessel had a 20.5 liter capacity with an L:D of 52:1. During the tests, the cuttings remained in the extraction vessel throughout, while carbon dioxide flowed continuously into the test vessel. The temperature of the vessel and its contents was largely controlled by the flow of carbon dioxide into the test vessel, with a heating jacket available if required. During start up, the test vessel was pressurized to a desired extraction condition, thereby allowing the cuttings time to adjust to the operating temperature of the carbon dioxide flow. Depending on the desired temperature, pressure, and vessel specifications used, the pressurization took up to one hour, with the average time approximately 45 minutes.

To determine the oil extraction rates during each run, downstream filters were used to capture the recovered oil, thereby allowing the volume of oil collected to be measured in relation to the flow of carbon dioxide.

Table 1, below, summarizes the extraction test results performed on three samples.

TABLE 1

| | TEST | | |
|---|---|---|---|
| | 1 | 2 | 3 |
| Mass cuttings (kg) | 10 | 10 | 10 |
| Temp (F.) | 65 | 32 | 32 |
| Temperature, C. | 18.33 | 0 | 0 |
| Pressure (psi) | 1000.00 | 1500.00 | 1000.00 |
| Pressure (bar) | 68.95 | 103.42 | 68.95 |
| Density (kg/m$^3$) | 823 | 960 | 928 |
| S:F ratio | 6 | 8 | 10 |
| Direction of Flow | Down | Up | Up |
| Carbon Dioxide Flow Rate (lb/min) | 1 | 1-2 | 1-2 |
| Process Time (min) | 150 | 60 | 60 |
| L:D Ration | 2:1 | 52:1 | 52:1 |
| Oil Collected (ml) | 840 | 890 | 800 |
| Cuttings Weight Loss (g) | 710 | 775 | 776 |
| Material Balance (%) | 99.9 | 99.7 | 98.9 |
| Retort Percent (dry basis), final average | 1.6 | 1.0 | 1.2 |

As the test result show, use of liquid carbon dioxide in the subcritical range (Test 1) and in the low temperature range (Tests 2 and 3) decreased the hydrocarbon content of the cuttings to 1.6% w/w (Test 1), 1.0% w/w (Test 2), and 1.2% w/w (Test 3).

Advantageously, embodiments disclosed herein may provide systems and methods for processing drill cuttings with increased efficiency. Additionally, such systems and methods may result in operations with lower energy requirements. The methods and systems may also allow for the recovery of hydrocarbons at both off-shore and on-shore drilling sites, wherein such hydrocarbons may be used in reformulating drilling muds.

While the present disclosure has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A system comprising;

at least one extraction tank;

a carbon dioxide tank fluidly connected to the at least one extraction tank, carbon dioxide supplied to the at least one extraction tank to extract hydrocarbons from drill cuttings therein;

at least one separation tank in fluid communication with the at least one extraction tank, carbon dioxide being separated from hydrocarbons at the at least one separation tank; and a pump in fluid communication with the extraction tank, the pump to displace residual carbon dioxide inside the at least one extraction tank to the carbon dioxide tank after a mixture of carbon dioxide and hydrocarbons is moved to the at least one separation tank.

2. The system according to claim 1, wherein the system comprises a cuttings storage tank.

3. The system according to claim 1, wherein the system comprises a plurality of extraction tanks.

4. The system according to claim 1, wherein the at least one extraction tank comprises an outlet for removing clean drill cuttings.

5. The system according to claim 1, wherein the at least one extraction tank comprises a mechanical agitator.

6. The system according to claim 1, further comprising at least one pump in fluid communication with the at least one extraction tank to provide a carbon dioxide extract recirculation loop.

7. The system according to claim 1, further comprising at least one carbon dioxide heater fluidly connected to the at least one extraction tank.

8. The system according to claim 1, wherein the system comprises a plurality of separation tanks.

9. The system according to claim 1, further comprising at least one carbon dioxide condenser in communication with the at least one separation tank, wherein the at least one carbon dioxide condenser is configured to convert carbon dioxide vapor into liquid carbon dioxide.

10. The system according to claim 1, further comprising a collection tank in fluid communication with the at least one separation tank.

11. The system according to claim 1, further comprising liquid carbon dioxide, wherein the liquid carbon dioxide is below the saturation temperature for carbon dioxide.

12. The system according to claim 11, wherein the liquid carbon dioxide is at a temperature ranging from about −20° C. and about 20° C.

13. The system according to claim 1, wherein the pump supplies water to the extraction tank.

14. The system of claim 1, wherein the carbon dioxide tank is in fluid communication with a power generator.

15. The system of claim 14, wherein the carbon dioxide tank is in fluid communication with a flue gas stream.

16. The system of claim 1, wherein the extraction tank is in fluid communication with a pressurized vessel, wherein the pressurized vessel is configured to provide drill cuttings to the extraction tank.

17. A system comprising:

at least one extraction tank;

a carbon dioxide tank fluidly connected to the at least one extraction tank, carbon dioxide supplied to the at least one extraction tank to extract hydrocarbons from drill cuttings therein; and at least one separation tank in fluid communication with the at least one extraction tank, wherein the extraction tank is in fluid communication with a pressurized vessel, wherein the pressurized vessel is configured to provide drill cuttings to the extraction tank.

18. The system according to claim 17, wherein the pressurized vessel supplies transfers the drill cuttings by supplying air.

19. A system comprising;

at least one extraction tank;

a carbon dioxide tank fluidly connected to the at least one extraction tank, carbon dioxide supplied to the at least one extraction tank to extract hydrocarbons from drill cuttings therein;

at least one separation tank in fluid communication with the at least one extraction tank; and at least one pump in fluid communication with the at least one extraction tank to provide a carbon dioxide extract recirculation loop.

20. The system according to claim 19, wherein the carbon dioxide extract recirculation loop increases saturation of carbon dioxide with hydrocarbons.

* * * * *